US006095932A

United States Patent [19]

Umezawa et al.

[11] Patent Number: 6,095,932

[45] Date of Patent: Aug. 1, 2000

[54] WOUND GOLF BALL

[75] Inventors: Junji Umezawa; Shinichi Kakiuchi, both of Chichibu, Japan

[73] Assignee: Bridgestone Sports Co., Ltd., Tokyo, Japan

[21] Appl. No.: 09/120,370

[22] Filed: Jul. 22, 1998

[30] Foreign Application Priority Data

Jul. 22, 1997 [JP] Japan ..... 9-211268

[51] Int. Cl.[7] ..... A63B 37/06; A63B 37/12

[52] U.S. Cl. ..... 473/356; 473/372; 473/363

[58] Field of Search ..... 473/365, 354, 473/357, 409, 363–364, 361, 372–374, 378; 273/DIG. 22, DIG. 20

[56] References Cited

U.S. PATENT DOCUMENTS 5,628,699 5/1997 Maruko et al. ..... 473/365 X
5,762,568 6/1998 Kato ..... 473/365
5,976,035 11/1999 Umezawa et al. ..... 473/364

FOREIGN PATENT DOCUMENTS 4-48473 8/1992 Japan .
5-44303 7/1993 Japan .
8-224323 9/1996 Japan .
8-33248 12/1996 Japan .

*Primary Examiner*—Steven Wong
*Assistant Examiner*—Mitra Aryanpour
*Attorney, Agent, or Firm*—Sughrue, Mion, Zinn, Macpeak & Seas, PLLC

[57] ABSTRACT

In a wound golf ball comprising a solid center, thread rubber winding and a cover, the cover is formed to a multilayer structure including an outer layer having a specific gravity of 0.95–1.2 and an inner layer having a higher hardness than said outer layer and a specific gravity of 1.1–1.4. The ball is improved in distance, spin and durability.

10 Claims, 1 Drawing Sheet

WOUND GOLF BALL

BACKGROUND OF THE INVENTION

1. Field of the Invention

This invention relates to a wound golf ball having a solid center, which is improved in flight performance, spin, and durability.

2. Prior Art

Prior art wound golf balls of the solid center type include those having ionomer resin covers and those having balata rubber covers. As compared with the wound balata balls, the wound golf balls using ionomer resins as the cover stock are superior in flight distance on driver shots, but inferior in spin properties necessary for approach play on the green (an appropriate stop on the green). On the other hand, the wound balata balls are less durable, for example, in that their cover presenting the ball surface can be scuffed or fretted by bunker shots and cut when topped with iron clubs.

To solve the above-mentioned problems, the assignee of the present invention proposed several wound golf balls having a solid center and a cover of multilayer structure including outer and inner layers, for example, in U.S. Pat. No. 5,628,699 a wound golf ball wherein the cover outer layer has a gage of at least 0.4 mm; in U.S. Ser. No. 08/659259, a wound golf ball wherein the cover inner layer is formed of an ionomer resin having an acid content of less than 15% by weight and the cover outer layer is formed of a resin having a Shore D hardness of 43 to 53; in U.S. Ser. No. 09/41017, a wound golf ball wherein an adhesive layer is interleaved between the cover inner and outer layers; and a wound golf ball wherein the solid center has an outer diameter of 27 to 38 mm and a distortion of 1.5 to 3.5 mm under a load of 30 kg, the ball shows a rebound height of at least 96 cm when dropped from a height of 120 cm, and has a total number of 350 to 500 dimples and a dimple volume/ball volume proportion of 0.76 to 0.9%. These balls are improved in that they travel a distance at least equal to the prior art wound golf balls having a solid center enclosed with a high hardness ionomer resin cover, they exhibit spin properties comparable to the wound balata balls, and their cover is not readily cut when topped with iron clubs.

There is still a desire to have a wound golf ball which is more superior in flight distance, spin and durability.

There was also proposed in JP-B 44303/1993 a golf ball in which the cover is formed to a high degree of whiteness from a cover stock comprising 100 parts of an ionomer resin and 1 to 10 parts by weight of an inorganic white pigment containing at least 50% by weight of barium sulfate having a particle size of 1 to 10 $\mu$m.

JP-B 48473/1992 disclose a solid golf ball having a cover of two-layer structure of outer and inner layers in which the specific gravity, gage and Shore D hardness of the cover layers are restricted to specific ranges, and the cover inner layer is adjusted using a filler (e.g., tungsten or molybdenum) having a specific gravity of 10 to 20. Since the cover of this golf ball is formed by compression molding, it is difficult to achieve full amalgamation of the cover stock to the thread rubber layer and hence, the cover becomes less durable. Another drawback is that the ball is less satisfactory in spin when hit with a short iron.

SUMMARY OF THE INVENTION

Therefore, an object of the invention is to provide a wound golf ball having a solid center, which is satisfactory in flight distance and spin while it is fully durable.

Regarding a wound golf ball comprising a wound core having thread rubber wound on a solid center and a cover surrounding the wound core and having a multilayer structure including an outer layer and an inner layer, the inventors made investigations on the specific gravity and hardness of the cover layers, the base materials and fillers of the cover layers, and the resilience of the core. The inventors have found that by optimizing the hardness and specific gravity of the cover layers, the moment of inertia is increased, the cover is improved in resilience, and the flow of cover stocks is significantly improved. The performance of the wound golf ball is improved.

The present invention provides a wound golf ball comprising a solid center having thread rubber wound thereon and a cover surrounding the wound center. The cover has a multilayer structure including an outer layer and an inner layer having a higher hardness than the outer layer. The cover outer layer has a specific gravity of 0.95 to 1.2 and the cover inner layer has a specific gravity of 1.1 to 1.4.

In preferred embodiments of the invention, the cover outer layer is composed mainly of an ionomer resin and has a gage of 0.4 to 1.5 mm and a Shore D hardness of 38 to 55; the cover inner layer is composed mainly of an ionomer resin loaded with a filler containing at least 50% by weight of barium sulfate and has a gage of 0.6 to 1.5 mm and a Shore D hardness of 55 to 68; the difference in hardness between the cover inner layer and the cover outer layer is at least 5 on Shore D hardness scale; the solid center has an outer diameter of 30 to 36 mm and a rebound height of 95 to 108 cm. when dropped from a height of 120 cm.

BRIEF DESCRIPTION OF THE DRAWINGS

The sole FIGURE.

DETAILED DESCRIPTION OF THE INVENTION

Figure 1:
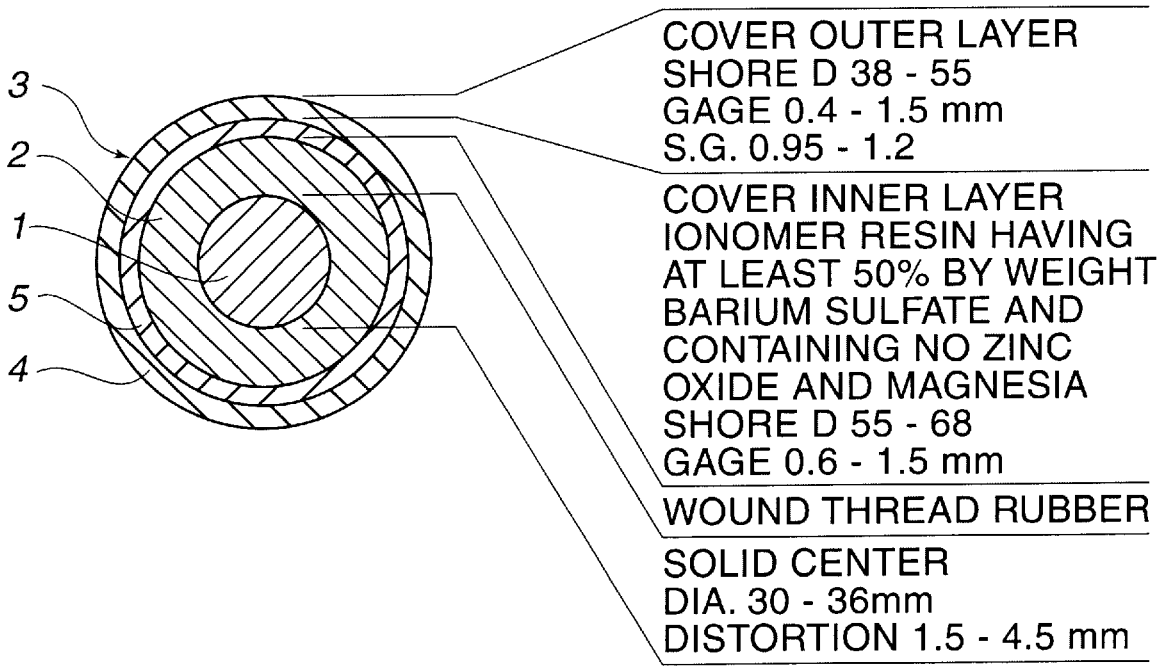
FIG. 1 is a schematic cross-sectional view of a wound golf ball according to the invention.

Referring to FIG. 1, a wound golf ball according to the invention is illustrated as comprising a solid center 1, a thread rubber layer 2 formed by winding thread rubber around the solid center, and a cover 3 enclosing the thread rubber layer 2. The cover 3 is constructed as a multilayer structure including an outer layer 4 and an inner layer 5.

According to the invention, the cover inner layer 5 has a higher hardness than the cover outer layer 4, and each of the cover outer and inner layers 4 and 5 has a specific gravity within the specific range.

The cover outer and inner layers 4 and 5 may be formed of well-known cover-forming resin compositions such as ionomer resins and balata rubber. Preferably, both the layers are formed of ionomer resins.

The cover outer layer 4 is preferably formed of a resin having a Shore D hardness of 38 to 55, more preferably. 42 to 52, typically ionomer resins, for example, Himilan 8120, 8220 and 8320 commercially available from Mitsui-duPont Polychemical K.K. and a mixture of two or more.

The cover inner layer 5 is preferably formed of a resin having a Shore D hardness of 55 to 68, more preferably 57 to 65, typically ionomer resins, for example, Himilan 1554, 1555, 1601, 1702, 1705 and 1706 commercially available from Mitsui-duPont Polychemical K.K. and a mixture of two or more. The difference in hardness between the resin of the cover outer layer and the resin of the cover inner layer is preferably at least 5 and more preferably at least 8 on Shore D hardness scale.

Preferably the cover outer layer has a gage (or radial thickness) of 0.4 to 1.5 mm, especially 0.6 to 1.2 mm. An outer layer of thinner than 0.4 mm would provide the ball with less satisfactory spin on approach shots. An outer layer of thicker than 1.5 mm would provide the ball with less resilience which can lead to a shorter distance.

Also preferably the cover inner layer has a gage (or radial thickness) of 0.6 to 1.5 mm, especially 0.8 to 1.2 mm. An inner layer of thinner than 0.6 mm would render the ball less durable against topping. An inner layer of, thicker than 1.5 mm would provide the ball with less resilience.

It is recommended that the sum of the gages of the cover outer and inner layers 4 and 5 is 1 to 3 mm, especially 1.5 to 2.5 mm. Further preferably, the ratio of the gage of the outer layer to the gage of the inner layer is from 3/7 to 7/3. A total gage of less than 1 mm would render the ball less durable against topping whereas a total gage of more than 3 mm would be difficult to ensure an initial velocity for the ball. If the ratio of the gage of the outer layer is below the defined range, the ball would be poor in spin upon approach shots. If the ratio of the gage of the outer layer is above the defined range, the flight distance on driver shots would become shorter.

According to the invention, the specific gravities of the cover inner and outer layers should be optimized as described above. Specifically, the cover inner layer should have a specific gravity of 1.1 to 1.4, especially 1.1 to 1.3, and the cover outer layer have a specific gravity of 0.95 to 1.2, especially 0.95 to 1.1. If the specific gravity of the cover inner layer is outside the range, the cover stock of which the layer is formed somewhat loses fluidity, does not fully penetrate into the thread rubber layer, and fails to ensure the amalgamation of the inner layer 5 with the thread rubber layer 2, losing durability against repetitive shots. If the specific gravity of the cover outer layer is outside the range, the cover can be fluffed upon iron shots.

For adjusting the specific gravity of cover stocks, well-known fillers are used. For example, pigments such as titanium white and dispersants such as magnesium stearate may be added in conventional amounts. It is recommended for adjusting the specific gravity of the cover inner layer that the filler contains at least 50% by weight of barium sulfate. Then the inner layer material becomes more likely to penetrate into the thread rubber layer, contributing to an improvement in durability. It is preferable not to add oxides such as zinc oxide and magnesia to the cover inner layer stock. Inner layer materials having such oxides blended therein lose fluidity, are not fully plasticized when molding, do not fully penetrate into the thread rubber layer, and fail to ensure the amalgamation of the inner layer with the thread rubber layer, losing durability against repetitive shots.

The wound golf ball of the invention has a solid center. As compared with a wound golf ball having a liquid center, it is more advantageous in suppressing the reduction of flight distance when used at low temperatures. The solid center preferably has an outer diameter of 30 to 36 mm, especially 32 to 34 mm. If the solid center has an outer diameter of less than 30 mm, the ball would receive more spin, follow a rather skiing trajectory and thus cover an insufficient distance against the wind. If the solid center has an outer diameter of more than 36 mm, the amount of thread rubber wound would be reduced so that the ball as a whole may not have an adequate hardness unless the solid center is remarkably hard, which adversely affects the feel of the ball when hit.

Also preferably, the solid center rebounds to a height of 95 to 108 cm, especially 97 to 105 cm when dropped from a height of 120 cm. If the rebound height of the solid center is less than 95 mm, the ball would become less resilient, failing to travel a distance.

The solid center can be produced by a well-known method, for example, by heat compression molding of a conventional rubber composition comprising base rubber, a co-crosslinking agent, and a peroxide.

More particularly, the base rubber used herein may be polybutadiene rubber or a mixture of polybutadiene rubber and polyisoprene rubber as used in conventional solid golf balls although 1,4-polybutadiene rubber having at least 90% of cis-structure is preferred, especially for high restitution. The co-crosslinking agent which can be used herein include zinc and magnesium salts of unsaturated fatty acids such as acrylic acid and methacrylic acid and ester compounds such as trimethylpropane trimethacrylate as used in the prior art. Zinc acrylate is preferred because high resilience is expectable. The amount of the co-crosslinking agent blended is preferably 15 to 30 parts by weight per 100 parts by weight of the base rubber. Various peroxides are useful although dicumyl peroxide or a mixture of dicumyl peroxide and 1,1-bis(t-butylperoxy)-3,3,5-trimethyl-cyclohexane are preferred. The amount of the peroxide blended is preferably 0.5 to 1.5 parts by weight per 100 parts by weight of the base rubber.

If desired, zinc oxide or barium sulfate may be blended in the rubber composition for adjusting the specific gravity. Blending of other additives such as anti-oxidants is acceptable.

The hardness of the solid center is not critical and it is usually determined in accordance with the feel that the player gets upon impacts causing large quantities of deformation as in driver shots and the head speed of the player. Typically, the solid center has a hardness corresponding to a distortion of 1.5 to 4.5 mm, especially 1.8 to 3.5 mm under a load of 30 kg.

The type and winding method of thread rubber wound on the solid center are well known.

The wound core composed of the solid center and the thread rubber layer is enclosed with the cover of multilayer structure by well-known processes, for example, by repeating the step of directly injection molding a cover stock on the wound core. Alternatively, the cover may be applied by performing hemispherical half cups from cover stocks, encasing the wound core in the half cups, and effecting heat pressure molding at 110 to 160° C. for 2 to 10 minutes. Since the cover inner layer stock is improved in fluidity, it well penetrates into the thread rubber layer. Even in the case of compression molding, the adhesion between the cover inner layer and the thread rubber layer becomes strong so that a highly durable wound golf ball may be obtained.

The wound golf ball of the invention should have a diameter of not less than 42.67 mm and a weight of not greater than 45.92 grams in accordance with the Rules of Golf.

EXAMPLE

Examples of the present invention are given below together with Comparative Examples by way of illustration and not by way of limitation.

Examples 1–5 and Comparative Examples 1–4

Solid centers were formed by kneading in a roll mill rubber compositions of the formulation shown in Table 1, and press molding at 150° C. for 15 minutes.

TABLE 1

| | Solid center | | | | | |
|---|---|---|---|---|---|---|
| | A | B | C | D | E | F |
| Formulation (pbw) | | | | | | |
| Cis-1, 4-polybutadiene rubber | 100 | 100 | 100 | 100 | 100 | 80 |
| Natural rubber | — | — | — | — | — | 20 |
| Zinc acrylate | 20 | 20 | 20 | 10 | 20 | 20 |
| Zinc oxide | 10 | 10 | 10 | 20 | 10 | 10 |
| Barium sulfate | 38.5 | 35 | 26 | 22 | 53 | 38 |
| Dicumyl peroxide | 1.2 | 1.2 | 1.2 | 1.2 | 1.2 | 1.2 |
| Solid center | | | | | | |
| Outer diameter (mm) | 32.1 | 32.0 | 33.8 | 33.8 | 31.9 | 32.0 |
| Weight (g) | 22.6 | 22.0 | 25.2 | 25.2 | 23.6 | 22.7 |
| Specific gravity | 1.30 | 1.28 | 1.25 | 1.25 | 1.39 | 1.31 |
| Hardness[1)] (mm) | 1.85 | 1.90 | 1.75 | 3.05 | 1.90 | 1.95 |
| Rebound[2)] (cm) | 100.0 | 100.5 | 101.0 | 103.5 | 98.0 | 94.0 |

[1)]a distortion (mm) of a solid center under a load of 30 kg
[2)]a rebound height (cm) of a solid center when dropped from a height of 120 cm Thread rubber of the formulation shown in Table 2 was wound around the solid centers by a conventional winding method to produce wound cores having an outer diameter of about 39.2 mm.

TABLE 2

| Thread rubber | |
|---|---|
| Components | Parts by weight |
| Polyisoprene rubber | 70 |
| Natural rubber | 30 |
| Zinc oxide | 1.5 |
| Stearic acid | 1 |
| Vulcanization accelerator | 1.5 |
| Sulfur | 1 |

Resin compositions of the formulation shown in Table 3 were kneaded in a twin-screw extruder, obtaining cover stocks. Half cups were molded from the cover stocks. Two pairs of half cups were lapped in the combination shown in Table 4. Each wound core was then encased in two pairs of lapped half cups, which were subject to compression molding to form a two-layer cover. Wound golf balls were obtained in this manner.

The golf balls were hit with a driver at a head speed of 45 m/s (W#1/HS=45) and with a sand wedge at a head speed of 20 m/s (SW/HS=20). Measured parameters were a spin rate, initial velocity, elevation angle, carry and total distance.

Also ten samples of each golf ball were hit 200 times with the driver at a head speed of 45 m/s. The number of unbroken ball samples was expressed as a durability index provided that the number of unbroken ball samples in Comparative Example 1 was 100. The results are shown in Table 4.

TABLE 3

| | Cover stock | | | | | | |
|---|---|---|---|---|---|---|---|
| Designation | H | I | J | K | L | M | O |
| Formulation (pbw) | | | | | | | |
| Himilan 1706 | 25 | 25 | 25 | 25 | — | — | — |
| Himilan 1605 | 50 | 50 | 50 | 50 | — | — | — |
| Himilan 1557 | 25 | 25 | 25 | 25 | 25 | — | — |
| Himilan 1856 | — | — | — | — | 25 | — | — |
| Himilan 1650 | — | — | — | — | — | 45 | 100 |
| Surlyn 8120 | — | — | — | — | 50 | — | — |
| Surlyn 8320 | — | — | — | — | — | 55 | — |
| Barium sulfate | 33 | 50 | 1 | 28 | 1 | 1 | 1 |
| Zinc oxide | — | — | — | 5 | — | — | — |
| Titanium oxide | 2 | 2 | 2 | 2 | 2 | 2 | 2 |
| Dispersant/pigment | 1 | 1 | 1 | 1 | 1 | 1 | 1 |
| Cover | | | | | | | |
| Specific gravity | 1.20 | 1.30 | 0.97 | 1.20 | 0.97 | 0.97 | 0.97 |
| MFR[3)] (g/10 min.) | 2.7 | 2.6 | 2.8 | 1.5 | 2.0 | 1.3 | 1.5 |
| Shore D hardness | 61 | 62 | 60 | 62 | 50 | 47 | 57 |

[3)]Melt flow index as measured at 190° C. according to JIS K-6760

TABLE 4

| | Example | | | | | Comparative Example | | | |
|---|---|---|---|---|---|---|---|---|---|
| | 1 | 2 | 3 | 4 | 5 | 1 | 2 | 3 | 4 |
| Solid center | | | | | | | | | |
| Formulation | A | B | C | D | D | E | A | F | A |
| Specific gravity | 4.30 | 1.28 | 1.25 | 1.25 | 1.25 | 1.39 | 1.30 | 1.31 | 1.30 |
| Outer diameter (mm) | 32.1 | 32.0 | 33.8 | 33.8 | 33.8 | 31.9 | 32.1 | 32.0 | 32.1 |
| Weight (g) | 22.6 | 22.0 | 25.2 | 25.2 | 25.2 | 23.6 | 22.6 | 22.7 | 22.6 |
| Hardness (mm) | 1.85 | 1.90 | 1.75 | 3.05 | 3.05 | 1.90 | 1.85 | 1.95 | 1.85 |
| Rebound (cm) | 100.0 | 100.5 | 101.0 | 103.5 | 103.5 | 98.0 | 100.0 | 94.0 | 98.0 |
| Cover inner layer | | | | | | | | | |
| Formulation | H | I | H | H | H | J | K | H | H |
| Specific gravity | 1.20 | 1.30 | 1.20 | 1.20 | 1.20 | 0.97 | 1.20 | 1.20 | 1.20 |
| Shore D hardness | 61 | 62 | 61 | 61 | 61 | 60 | 62 | 61 | 61 |
| Gage (mm) | 1.0 | 1.0 | 1.0 | 1.0 | 1.0 | 1.0 | 1.0 | 1.0 | 1.0 |

TABLE 4-continued

| | Example | | | | | Comparative Example | | | |
|---|---|---|---|---|---|---|---|---|---|
| | 1 | 2 | 3 | 4 | 5 | 1 | 2 | 3 | 4 |
| MFR (g/10 min.) | 2.7 | 2.6 | 2.7 | 2.7 | 2.7 | 2.8 | 1.5 | 2.7 | 2.7 |
| Cover outer layer | | | | | | | | | |
| Formulation | L | L | L | L | M | L | L | L | O |
| Specific gravity | 0.97 | 0.97 | 0.97 | 0.97 | 0.97 | 0.97 | 0.97 | 0.97 | 0.97 |
| Shore D hardness | 50 | 50 | 50 | 50 | 47 | 50 | 50 | 50 | 57 |
| Gage (mm) | 0.8 | 0.8 | 0.8 | 0.8 | 0.8 | 0.8 | 0.8 | 0.8 | 0.8 |
| Ball | | | | | | | | | |
| Outer diameter (mm) | 42.68 | 42.68 | 42.69 | 42.69 | 42.68 | 42.68 | 42.69 | 42.68 | 42.68 |
| Weight (g) | 45.2 | 45.1 | 45.2 | 45.1 | 45.1 | 45.2 | 45.2 | 45.3 | 45.2 |
| Hardness (mm) | 2.95 | 2.98 | 2.93 | 2.95 | 2.85 | 3.00 | 3.05 | 2.95 | 2.90 |
| W#1/HS = 45 | | | | | | | | | |
| Spin (rpm) | 2650 | 2600 | 2550 | 2480 | 2610 | 2720 | 2660 | 2620 | 2490 |
| Initial velocity (m/s) | 65.5 | 65.5 | 65.5 | 65.6 | 65.7 | 65.3 | 65.4 | 65.1 | 65.3 |
| Elevation angle (°) | 12.0 | 11.9 | 11.9 | 11.8 | 11.9 | 12.2 | 12.0 | 11.8 | 11.8 |
| Carry (m) | 208.1 | 207.5 | 207.3 | 206.9 | 208.6 | 208.0 | 207.8 | 206.3 | 207.7 |
| Total (m) | 221.9 | 222.8 | 223.4 | 224.5 | 222.5 | 218.9 | 221.8 | 216.8 | 221.5 |
| SW/HS = 20 | | | | | | | | | |
| Spin (rpm) | 5750 | 5780 | 5700 | 5700 | 5950 | 5580 | 5520 | 5460 | 4890 |
| Durability index | 100 | 100 | 100 | 100 | 100 | 100 | 75 | 100 | 100 |

There has been described a wound golf ball comprising a solid center, thread rubber winding and a multilayer cover including inner and outer layers whose hardness and specific gravity is adjusted optimum. The ball features an increased distance, appropriate spin, and high durability.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising; a solid center having thread rubber wound thereon and a cover surrounding the wound center, said solid center having an outer diameter of 30 to 36 mm and a rebound height of 95 to 108 cm when dropped from a height of 120 cm, said cover having a multilayer structure including an outer layer and an inner layer, said outer layer composed mainly of an ionomer resin and has a gage of 0.4 to 1.5 mm, a Shore D hardness of 38 to 55 and a specific gravity of 0.95 to 1.2, and said inner layer composed mainly of an ionomer resin loaded with a filler containing at least 50% by weight of barium sulfate and not containing zinc oxide and magnesia, said cover inner layer having a gage of 0.6 to 1.5 mm, a Shore D hardness of 55 to 68 and a specific gravity of 1.1 to 1.4, said cover inner layer having a higher hardness than said outer layer.

2. The wound golf ball of claim 1 wherein the difference in hardness between said cover inner layer and said cover outer layer is at least 5 on Shore D hardness scale.

3. The wound golf ball of claim 1, wherein said solid center has an outer diameter of 32–34 mm.

4. The wound golf ball of claim 3, wherein the total gage of said cover inner and outer layers is in the range of 1 to 3 mm.

5. The wound golf ball of claim 1, wherein said cover outer layer has a gage of 0.6 to 1.2 mm.

6. The wound golf ball of claim 1, wherein said cover outer layer has a Shore D hardness of 42 to 52.

7. The wound golf ball of claim 1, wherein said cover inner layer has a Shore D hardness of 57 to 65.

8. The wound golf ball of claim 1, wherein the difference in hardness between said cover inner layer and said cover outer layer is at least 8 on Shore D hardness scale.

9. The wound golf ball of claim 1, wherein said cover inner layer has a gage of 0.8 to 1.2.

10. The wound golf ball of claim 1, wherein said cover inner layer has a specific gravity of 1.1 to 1.3 and said cover outer layer has a specific gravity of 0.95 to 1.1.

* * * * *